US010551071B2

(12) United States Patent
Bianchi et al.

(10) Patent No.: US 10,551,071 B2
(45) Date of Patent: Feb. 4, 2020

(54) OVEN RACK SYSTEM WITH REMOVABLE SUPPORT ELEMENTS

(71) Applicant: WHIRLPOOL CORPORATION, Benton Harbor, MI (US)

(72) Inventors: Fabio Bianchi, Cassinetta di Biandronno (IT); Michele H. Johnson, St. Joseph, MI (US); Budda Govindarajulu Karthikeyan, Maharashtra (IN); Alberto Castiglioni, Porto Valtravaglia (IT)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/977,018

(22) Filed: May 11, 2018

(65) Prior Publication Data

US 2019/0346148 A1 Nov. 14, 2019

(51) Int. Cl.
*F24C 15/16* (2006.01)
*A47L 15/50* (2006.01)

(52) U.S. Cl.
CPC ..... *F24C 15/16* (2013.01); *A47L 15/504* (2013.01); *A47L 15/506* (2013.01); *A47L 15/507* (2013.01)

(58) Field of Classification Search
CPC ..... F24C 15/16; A47L 15/504; A47L 15/506; A47L 15/507
USPC ..... 211/153; 312/408, 410
See application file for complete search history.

(56) References Cited

U.S. PATENT DOCUMENTS 774,117 A 11/1904 Tandy
1,952,148 A 3/1934 Stout
1,989,275 A * 1/1935 Hatch ..... F24C 15/16 126/337 R
1,997,432 A 4/1935 Replogle
2,065,391 A 12/1936 Nance
(Continued)

FOREIGN PATENT DOCUMENTS

BR PI0100491 B1 6/2009
BR 8802268 U2 2/2010
(Continued)

OTHER PUBLICATIONS

GE Appliances, Refrigerator Capacity & Organization: Making Room for More, Jan. 17, 2014, http://www.geappliances.com/appliances/refrigerators/refrigerator-capacity-organize.htm.
(Continued)

*Primary Examiner* — Hanh V Tran
(74) *Attorney, Agent, or Firm* — Price Heneveld LLP

(57) ABSTRACT

A rack system for a cooking appliance cavity includes a first support unit including a plurality of rack support bars and a first connecting member defining a body portion having the support bars coupled therewith, a first end with a first post and a first stepped segment between the first post and the body portion, and a second end with a second post and a second stepped segment between the second post and the body portion. The system further includes first and second mounting blocks, each defining a channel and a notch extending intersecting with the channel such that a first portion of the channel is open and a second portion of the channel is enclosed. The first and second posts are respectively received in the second portions of the channels of the first and second mounting blocks.

20 Claims, 6 Drawing Sheets

(56) References Cited

U.S. PATENT DOCUMENTS 2,187,916 A 1/1940 Seeger
2,225,762 A 12/1940 Barnsteiner
2,282,342 A 5/1942 Preble
2,412,904 A 12/1946 Money et al.
2,434,117 A 1/1948 Money et al.
2,466,360 A * 4/1949 Bitney ..... F24C 15/16 108/137
2,509,592 A 5/1950 Giffard
2,517,385 A 8/1950 Clark
2,573,272 A 10/1951 Petkwitz
2,597,267 A 5/1952 Shoemaker et al.
2,671,004 A * 3/1954 Chadwick ..... A47J 37/06 126/337 R
2,694,906 A 11/1954 Didion
2,710,993 A 6/1955 Kirkpatrick
2,737,782 A 3/1956 Antico
2,742,559 A * 4/1956 Edelman ..... A47J 37/041 126/273 R
2,748,573 A 6/1956 Staebler et al.
2,773,677 A 12/1956 Hinkel
2,804,068 A 8/1957 Miller et al.
2,841,132 A 7/1958 Philipp
2,875,016 A 2/1959 Fry
3,145,289 A * 8/1964 Swetlitz ..... F24C 3/027 126/19 M
3,266,858 A 8/1966 Klotz
3,295,904 A 1/1967 Cobb
3,410,260 A 11/1968 Morgan
3,454,744 A * 7/1969 Vonderhaar ..... F24C 14/00 219/393
3,706,302 A * 12/1972 Helgeson ..... F24C 15/007 126/19 R
3,866,437 A 2/1975 Spencer
3,984,163 A 10/1976 Boorman, Jr. et al.
4,597,616 A 7/1986 Trubiano
4,638,644 A 1/1987 Gidseg
4,729,613 A 3/1988 Tromble et al.
4,732,435 A 3/1988 Bailey et al.
4,735,470 A 4/1988 Falk
4,834,557 A 5/1989 Dreinhoff
4,914,928 A 4/1990 Fellwock et al.
4,998,382 A 3/1991 Kostos et al.
5,088,801 A 2/1992 Rorke et al.
5,273,354 A 12/1993 Herrman et al.
5,362,145 A 11/1994 Bird et al.
5,411,165 A 5/1995 Ellis
5,415,472 A 5/1995 Brise
5,429,043 A 7/1995 Becker
5,447,146 A 9/1995 Nickerson
5,469,999 A 11/1995 Phirippidis
5,485,933 A * 1/1996 Crooymans ..... A47B 96/063 211/153
5,524,981 A 6/1996 Herrmann et al.
5,564,809 A 10/1996 Kane et al.
5,605,344 A 2/1997 Insalaco et al.
5,651,597 A * 7/1997 Oslin ..... F24C 15/16 108/102
5,660,777 A 8/1997 Herrmann et al.
5,673,984 A 10/1997 Insalaco et al.
5,735,589 A 4/1998 Herrmann et al.
5,813,741 A 9/1998 Fish et al.
5,833,336 A 11/1998 Dean
5,918,959 A 7/1999 Lee
5,947,573 A 9/1999 Tovar et al.
6,045,101 A 4/2000 Goyette et al.
6,174,482 B1 1/2001 Reames et al.
6,220,684 B1 4/2001 Bent et al.
6,474,094 B2 11/2002 Kim
6,488,347 B1 12/2002 Bienick
6,578,720 B1 6/2003 Wang
6,604,800 B2 8/2003 Hamilton
6,811,045 B1 11/2004 Masker et al.
D505,140 S 5/2005 Reed et al.
D516,100 S 2/2006 Vardon
D516,102 S 2/2006 Vardon
7,021,730 B2 4/2006 Remmers
D523,034 S 6/2006 Vardon
7,059,693 B2 6/2006 Park
D525,633 S 7/2006 Vardon
7,070,249 B2 7/2006 Leimkuehler et al.
7,131,545 B1 11/2006 Grogan
7,178,890 B2 2/2007 Park et al.
7,188,738 B2 3/2007 Stafford et al.
7,232,194 B2 6/2007 Becke et al.
D547,640 S 7/2007 Remmers
D551,262 S 9/2007 Becke
7,270,385 B2 9/2007 Mathur et al.
D551,884 S 10/2007 Remmers
7,367,571 B1 5/2008 Nichols
7,467,834 B2 12/2008 Kim et al.
7,497,533 B2 3/2009 Remmers
7,552,983 B2 6/2009 Shin
7,651,182 B2 1/2010 Eveland et al.
7,726,753 B2 6/2010 Bassi
7,748,569 B2 7/2010 Sunatori
7,748,806 B2 7/2010 Egan
7,878,344 B2 2/2011 Martin et al.
7,976,113 B2 7/2011 Gwak
8,047,397 B2 11/2011 Mittet
D656,970 S 4/2012 Merritt
8,172,347 B2 5/2012 Lim et al.
8,182,056 B2 5/2012 Gossens et al.
8,240,512 B2 8/2012 Sunatori
D669,506 S 10/2012 Czach et al.
8,297,726 B2 10/2012 Ramm et al.
8,336,976 B2 12/2012 Lee
8,348,362 B2 1/2013 Candeo et al.
8,359,881 B2 1/2013 Junge et al.
8,381,949 B2 2/2013 Sunatori
8,403,438 B2 3/2013 Park et al.
8,414,095 B2 4/2013 Stewart
8,444,239 B2 5/2013 Gossens et al.
D692,034 S 10/2013 Seo et al.
8,562,089 B2 10/2013 Collins et al.
D694,288 S 11/2013 Hottmann et al.
D694,289 S 11/2013 Hottmann et al.
D694,292 S 11/2013 Eby et al.
8,616,665 B2 12/2013 Czach et al.
8,640,482 B2 2/2014 Lim et al.
8,726,689 B2 5/2014 Jang et al.
8,733,862 B1 5/2014 Armstrong et al.
D707,267 S 6/2014 Choi et al.
8,739,568 B2 6/2014 Allard et al.
D709,927 S 7/2014 Park et al.
8,777,341 B2 7/2014 Amaral et al.
D710,405 S 8/2014 Seo et al.
D710,406 S 8/2014 Seo et al.
D711,943 S 8/2014 Park et al.
8,814,287 B2 8/2014 Jang
8,833,882 B2 9/2014 Seo et al.
D714,840 S 10/2014 Yang et al.
D717,349 S 11/2014 Seo et al.
D719,986 S 12/2014 Kim et al.
8,960,826 B2 2/2015 Choo et al.
9,033,437 B2 5/2015 Klitzing et al.
D734,784 S 7/2015 Kim et al.
9,097,457 B2 8/2015 Kim
9,103,582 B2 8/2015 Nash et al.
9,127,878 B2 9/2015 Gossens et al.
9,131,785 B2 9/2015 Peru
9,151,534 B2 10/2015 Lee et al.
D745,581 S 12/2015 Jeon et al.
9,217,601 B2 12/2015 Koo et al.
D747,369 S 1/2016 McConnell et al.
D747,370 S 1/2016 Kim et al.
D747,371 S 1/2016 Lee et al.
D747,372 S 1/2016 Kim et al.
D747,373 S 1/2016 Lee et al.
D748,165 S 1/2016 McConnell et al.
9,234,690 B2 1/2016 McCollugh et al.
9,250,010 B2 2/2016 De La Garza et al.
9,297,573 B2 3/2016 Krause et al.
D754,759 S 4/2016 McConnell et al.

(56) References Cited

U.S. PATENT DOCUMENTS

| | | | | |
|---|---|---|---|---|
| 9,320,368 | B2 | 4/2016 | Marotti et al. | |
| 9,328,955 | B2 | 5/2016 | Castro Solis et al. | |
| 9,335,089 | B1 | 5/2016 | Gossens | |
| 9,339,993 | B2 | 5/2016 | Cites et al. | |
| 9,345,326 | B2 | 5/2016 | Sankhgond et al. | |
| D761,884 | S | 7/2016 | Austin et al. | |
| 9,453,673 | B2 | 9/2016 | Gossens | |
| 9,488,405 | B2 | 11/2016 | Lee et al. | |
| 9,500,403 | B2 | 11/2016 | Seo et al. | |
| 9,510,679 | B2 | 12/2016 | Bhatt et al. | |
| 9,574,820 | B2 | 2/2017 | Lee | |
| 9,671,115 | B2 | 6/2017 | Elkasevic | |
| 9,823,013 | B1 | 11/2017 | Caglin et al. | |
| 9,861,200 | B2 | 1/2018 | Lim | |
| 9,945,601 | B1 | 4/2018 | Bhavsar et al. | |
| 2003/0020387 | A1 | 1/2003 | Wing et al. | |
| 2004/0012314 | A1 | 1/2004 | Hay et al. | |
| 2004/0104323 | A1 | 6/2004 | Hubert et al. | |
| 2005/0073225 | A1 | 4/2005 | Kwon et al. | |
| 2005/0172830 | A1* | 8/2005 | Giraud | F24C 15/16 99/448 |
| 2006/0042305 | A1 | 3/2006 | Oh et al. | |
| 2006/0049731 | A1 | 3/2006 | Choi et al. | |
| 2006/0145577 | A1 | 7/2006 | Daley et al. | |
| 2006/0226749 | A1 | 10/2006 | Kim | |
| 2006/0226751 | A1 | 10/2006 | Park | |
| 2007/0113578 | A1 | 5/2007 | Wu et al. | |
| 2007/0126325 | A1 | 6/2007 | Gorz et al. | |
| 2007/0228904 | A1 | 10/2007 | Williams | |
| 2007/0235397 | A1 | 10/2007 | Wannop | |
| 2008/0203041 | A1 | 8/2008 | Lim et al. | |
| 2008/0315743 | A1 | 12/2008 | Oh | |
| 2009/0193836 | A1 | 8/2009 | Ertz et al. | |
| 2010/0024464 | A1 | 2/2010 | Hwang et al. | |
| 2010/0102693 | A1 | 4/2010 | Driver et al. | |
| 2010/0109498 | A1 | 5/2010 | Ramm et al. | |
| 2010/0155552 | A1* | 6/2010 | Mazzetti | F24C 15/16 248/220.21 |
| 2010/0218755 | A1* | 9/2010 | Stewart | F24C 15/168 126/339 |
| 2010/0219731 | A1 | 9/2010 | Candeo et al. | |
| 2011/0001415 | A1 | 1/2011 | Park et al. | |
| 2011/0072846 | A1 | 3/2011 | Engel et al. | |
| 2011/0115356 | A1 | 5/2011 | Nash et al. | |
| 2012/0018434 | A1 | 1/2012 | Gwak | |
| 2012/0024006 | A1 | 2/2012 | Knoll et al. | |
| 2012/0061534 | A1* | 3/2012 | Rehage | F24C 15/168 248/214 |
| 2012/0090594 | A1* | 4/2012 | Rehage | F24C 15/168 126/339 |
| 2012/0091084 | A1 | 4/2012 | Amaral et al. | |
| 2012/0223038 | A1 | 9/2012 | Bean | |
| 2012/0248958 | A1 | 10/2012 | Ertz et al. | |
| 2013/0020922 | A1 | 1/2013 | Jang | |
| 2013/0098856 | A1* | 4/2013 | Troyner | A47B 57/402 211/153 |
| 2013/0119846 | A1 | 5/2013 | Seo et al. | |
| 2013/0146553 | A1* | 6/2013 | Preidt | A47F 5/00 211/153 |
| 2013/0147337 | A1 | 6/2013 | Lim | |
| 2013/0219731 | A1 | 8/2013 | Zhang | |
| 2013/0280542 | A1* | 10/2013 | Herbolsheimer | C23C 16/029 428/448 |
| 2014/0216095 | A1 | 8/2014 | Leclear et al. | |
| 2014/0217044 | A1 | 8/2014 | Cole | |
| 2015/0034668 | A1 | 2/2015 | Minard et al. | |
| 2015/0061484 | A1 | 3/2015 | Jeong et al. | |
| 2015/0068999 | A1 | 3/2015 | Dart et al. | |
| 2015/0107084 | A1 | 4/2015 | Craycraft et al. | |
| 2015/0168048 | A1 | 6/2015 | Sexton et al. | |
| 2015/0184929 | A1 | 7/2015 | Moon | |
| 2015/0216303 | A1* | 8/2015 | Rehage | F16C 29/046 312/334.17 |
| 2015/0351532 | A1 | 12/2015 | Peru | |
| 2016/0067863 | A1 | 3/2016 | Cole | |
| 2016/0290707 | A1 | 10/2016 | Burke et al. | |
| 2017/0086580 | A1 | 3/2017 | Conti | |
| 2017/0181538 | A1 | 6/2017 | Azkue et al. | |
| 2017/0276425 | A1 | 9/2017 | Fink et al. | |
| 2017/0341217 | A1 | 11/2017 | Cole | |
| 2018/0127007 | A1 | 5/2018 | Kravchenko | |

FOREIGN PATENT DOCUMENTS

| | | | |
|---|---|---|---|
| BR | PI0805999 | A2 | 6/2010 |
| CN | 1975301 | A | 6/2007 |
| CN | 101611281 | A | 12/2009 |
| CN | 201779952 | U | 3/2011 |
| CN | 102135363 | A | 7/2011 |
| CN | 102395849 | A | 3/2012 |
| CN | 102494496 | A | 6/2012 |
| CN | 202432813 | U | 9/2012 |
| CN | 102829604 | A | 12/2012 |
| CN | 102889744 | A | 1/2013 |
| CN | 203216196 | U | 9/2013 |
| CN | 101688748 | B | 12/2013 |
| CN | 103900317 | A | 7/2014 |
| CN | 104089457 | A | 10/2014 |
| CN | 104896859 | A | 9/2015 |
| CN | 205619680 | U | 10/2016 |
| CN | 205641793 | U | 10/2016 |
| CN | 205980510 | U | 2/2017 |
| CN | 106766627 | A | 5/2017 |
| DE | 8801508 | U1 | 6/1989 |
| DE | 19500371 | A1 | 7/1996 |
| DE | 700820 | T1 | 11/1996 |
| DE | 19750473 | A1 | 5/1999 |
| DE | 69519613 | T2 | 4/2001 |
| DE | 10107646 | A1 | 8/2002 |
| DE | 69529852 | T2 | 9/2003 |
| DE | 102009045363 | A1 | 4/2011 |
| DE | 102011003037 | A1 | 7/2012 |
| DE | 102013216974 | A1 | 4/2014 |
| DE | 102012223131 | A1 | 6/2014 |
| EP | 0577939 | A1 | 1/1994 |
| EP | 700820 | A2 | 3/1996 |
| EP | 579364 | B1 | 12/1997 |
| EP | 940316 | A2 | 9/1999 |
| EP | 1152201 | A1 | 11/2001 |
| EP | 1790250 | A2 | 5/2007 |
| EP | 1349802 | B1 | 8/2008 |
| EP | 1985205 | A1 | 10/2008 |
| EP | 2072937 | A2 | 6/2009 |
| EP | 2098810 | A2 | 9/2009 |
| EP | 2431688 | A1 | 3/2012 |
| EP | 2424421 | B1 | 10/2015 |
| EP | 2760315 | B1 | 8/2016 |
| EP | 2926069 | B1 | 11/2016 |
| EP | 3159635 | A1 | 4/2017 |
| EP | 3327390 | A1 | 5/2018 |
| ES | 2327831 | T3 | 11/2009 |
| IN | 201737009466 | | 8/2017 |
| JP | S4912073 | A | 2/1974 |
| JP | S5270567 | A | 5/1977 |
| JP | S5793706 | U | 6/1982 |
| JP | S59142618 | A | 9/1984 |
| JP | 52126461 | U | 9/1997 |
| JP | H110115485 | A | 5/1998 |
| JP | H110122733 | A | 5/1998 |
| JP | H111237173 | A | 8/1999 |
| JP | 2002090054 | A | 3/2002 |
| KR | 100364994 | B1 | 12/2002 |
| KR | 374557 | B1 | 3/2003 |
| KR | 20030061668 | A | 7/2003 |
| KR | 100431346 | B1 | 5/2004 |
| KR | 1020040070986 | | 8/2004 |
| KR | 20040095421 | A | 11/2004 |
| KR | 100559722 | B1 | 3/2006 |
| KR | 100756887 | B1 | 9/2007 |
| KR | 850005 | B1 | 8/2008 |
| KR | 2010026614 | A | 3/2010 |
| KR | 20100023474 | A | 3/2010 |
| KR | 20130015988 | A | 2/2013 |

(56) References Cited

FOREIGN PATENT DOCUMENTS

| | | | |
|---|---|---|---|
| KR | 20130016997 | A | 2/2013 |
| KR | 20140022598 | A | 2/2014 |
| KR | 2017043815 | A | 4/2017 |
| WO | 02014761 | A1 | 2/2002 |
| WO | 2004104504 | A1 | 12/2004 |
| WO | 2005012812 | A1 | 2/2005 |
| WO | 2005100887 | A1 | 10/2005 |
| WO | 2007128734 | A1 | 11/2007 |
| WO | 2008015180 | A2 | 2/2008 |
| WO | 2009155679 | A2 | 12/2009 |
| WO | 2011009773 | A2 | 1/2011 |
| WO | 2011080109 | A2 | 7/2011 |
| WO | 2012025382 | A2 | 3/2012 |
| WO | 2012062670 | A2 | 5/2012 |
| WO | 2013126515 | A1 | 8/2013 |
| WO | 2015101430 | A1 | 7/2015 |
| WO | 2015101434 | A1 | 7/2015 |
| WO | 2015149832 | A1 | 10/2015 |
| WO | 2015165531 | A1 | 11/2015 |
| WO | 2016155784 | A1 | 10/2016 |
| WO | 2017005314 | A1 | 1/2017 |

OTHER PUBLICATIONS

GE Appliances, GE Profile Side by Side Refrigerators, Jan. 17, 2014, http://www.abt.com/ge/GE_Profile_SideBySide.

* cited by examiner

OVEN RACK SYSTEM WITH REMOVABLE SUPPORT ELEMENTS

BACKGROUND

The present device generally relates to a rack system for an appliance. A number of different types of appliances, including cooking appliances such as ovens and the like, include racks positionable in various vertical locations within the interior of the appliance. The racks are configured to support cooking articles and/or food items thereon, for example, for cooking within the appliance. The racks are repositionable to provide the desired positioning relative to operative elements (such as burners or the like) for cooking of related food items, for example. Further, the racks are slideably supported to be extendable partially out of the appliance cavity for easier insertion and removal of the related cooking articles and food items. Various support structures have been used to provide for the needed retention, adjustment, and extension of such racks within the associated appliance.

SUMMARY

In at least one aspect, a rack system for a cooking appliance cavity includes a first support unit including a plurality of rack support bars extending in a first direction and a first connecting member extending in a second direction normal to the first direction and defining a body portion having the support bars coupled therewith, a first end with a first post and a first stepped segment between the first post and the body portion, and a second end with a second post and a second stepped segment between the second post and the body portion. The system further includes first and second mounting blocks, each defining a first face with a channel extending inwardly therefrom and a second face normal to the first face and having a notch extending inwardly therefrom and intersecting with the channel such that a first portion of the channel is open on the second surface and a second portion of the channel is enclosed behind the second face. The first and second mounting blocks are spaced apart with the respective notches thereof disposed toward each other and the first and second posts are respectively received in the second portions of the channels of the first and second mounting blocks.

In at least another aspect, a cooking appliance includes an interior cavity with a first vertical interior wall and first and second mounting blocks coupled with the first interior wall. Each mounting block defines a first face with a channel extending inwardly therefrom a second face normal to the first face and having a notch extending inwardly therefrom and intersecting with the channel such that a first portion of the channel is open on the second surface and a second portion of the channel is enclosed behind the second face. The first and second mounting blocks are spaced apart with the respective first surfaces thereof disposed toward each other. The appliance further includes a first support unit including a plurality of rack support bars extending in a first direction and a first connecting member extending in a second direction normal to the first direction and defining a body portion having the support bars coupled therewith, a first end with a first post and a first stepped segment between the first post and the body portion, and a second end with a second post and a second stepped segment between the second post and the body portion, the first and second posts being respectively received in the second portions of the channels of the first and second mounting blocks.

In at least another aspect, a rack system includes a first support unit including a plurality of rack support bars extending in a first direction and a first connecting member extending in a second direction normal to the first direction and defining a body portion having the support bars coupled therewith, a first end, and a second end opposite the first end. The system further includes first and second mounting blocks, each defining a first face with a channel extending inwardly therefrom a second face normal to the first face, each of the channels defining respective closed portions. The first and second mounting blocks are spaced apart with the first faces thereof facing each other, and the first and second ends of the first connecting member are respectively received in the closed portions of the channels of the first and second mounting blocks in a slidable manner such that the support unit is moveable into an intermediate position with the second post removed from the closed portion of the channel.

These and other features, advantages, and objects of the present device will be further understood and appreciated by those skilled in the art upon studying the following specification, claims, and appended drawings.

DETAILED DESCRIPTION OF EMBODIMENTS

Figure 1:
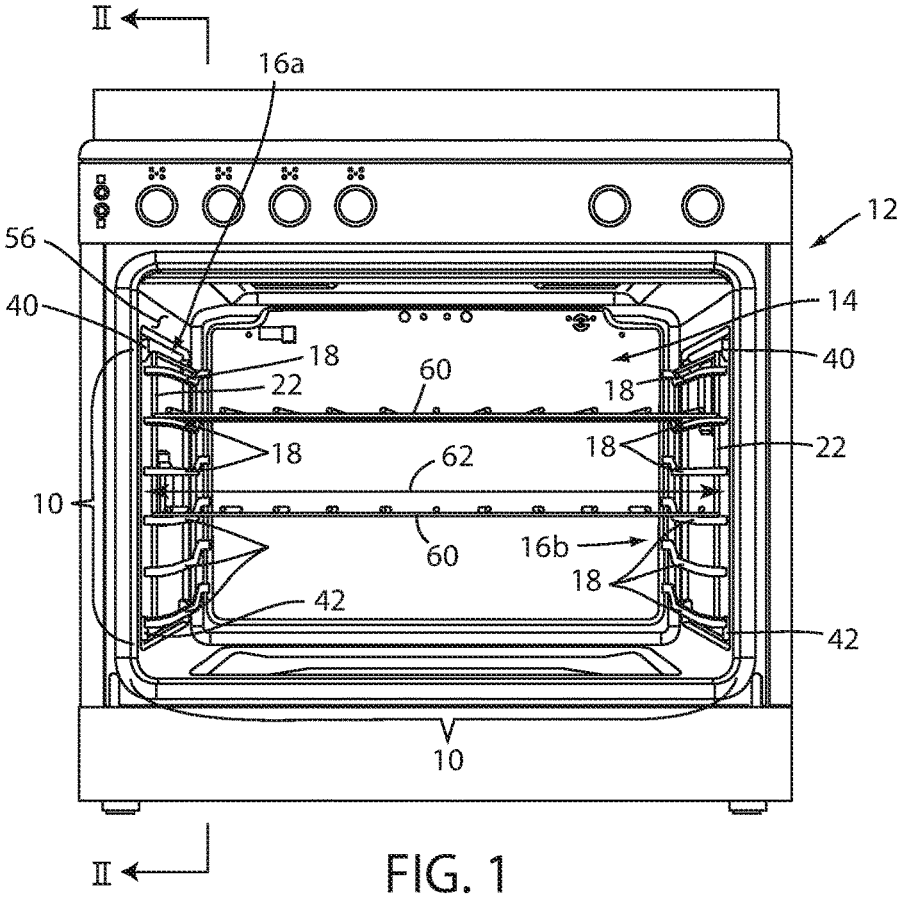
FIG. 1 is a front perspective view of an oven having an interior cavity with a rack system therein.
Figure 2:
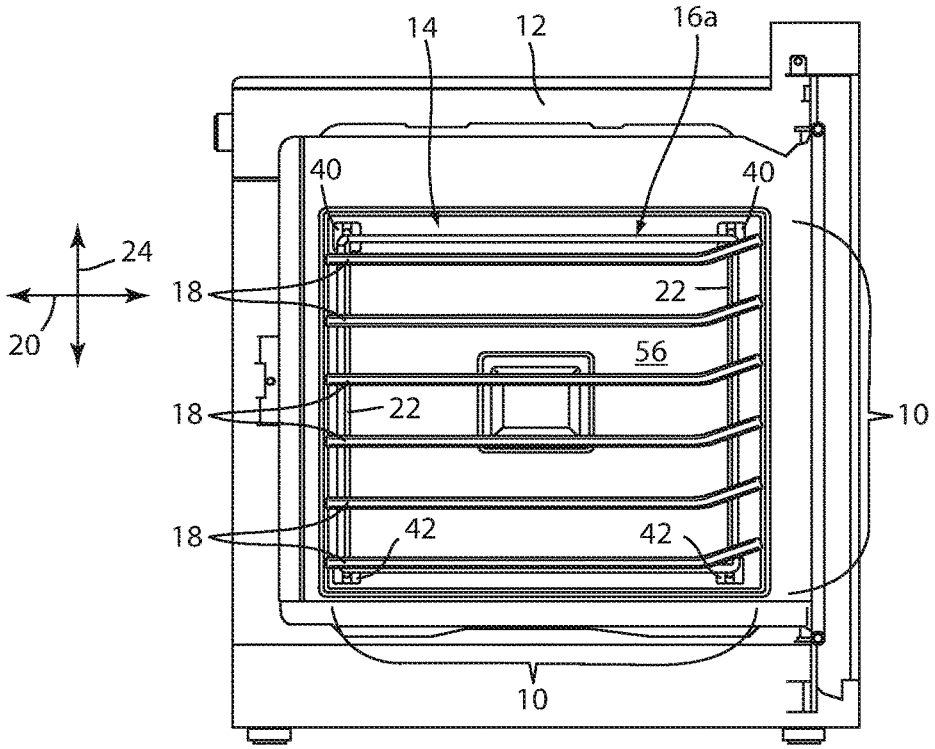
FIG. 2 is a side cutaway view showing portions of the rack system of FIG. 1.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to the embodiment illustrated in FIG. 1, reference numeral 10 generally designates a rack system for a cavity 12 of a cooking appliance 14. The system 10 includes a first support unit 16*a* including rack support bars 18 extending in a first direction 20 and a connecting member 22 extending in a second direction 24 normal to the first direction 20 and defining a body portion 26 having the support bars 18 coupled therewith. The connecting member 22 further includes a first end 28 with a first post 30 and a first stepped segment 32 between the first post 30 and the body portion 26, and a second end 34 with a second post 36 and a second stepped segment 38 between the second post 36 and the body portion 26. The system 10 further includes a first mounting block 40 and a second mounting block 42, each defining a first face 44 with a channel 46 extending inwardly therefrom and a second face 48 normal to the first face 44 and having a notch 50 extending inwardly therefrom and intersecting the channel 46 such that a first portion 52 of the channel 46 is open on the second face 48 and a second portion 54 of the channel 46 is enclosed behind the second face 48. The first 40 and second 42 mounting blocks are arranged in a pair corresponding with a position of the first connecting member 22 and are spaced apart with the respective notches 50 thereof disposed toward each other (i.e. with respect to the open portions 52 of the channels 48 as defined by the notches 50). The first 30 and second 36 posts are respectively received in the second portions 54 of the channels 48 of the first 40 and second 42 mounting blocks.

As further shown in FIGS. 1-10, the cooking appliance 14 can be in the form of an oven, and the interior cavity 12 can define a first vertical interior wall 56 with the first and second mounting blocks 40,42 coupled with the first interior wall 56 in the above-described spaced apart manner for retention of support unit 16*a* with interior wall 56. As shown, the cavity 12 of the appliance 14 is in the form of a typical oven interior cavity such that interior wall 56 extends to a depth comparable to that of an ordinary oven. In this manner, support unit 16*a* may extend a corresponding depth, such as through at least about 80% of the depth of wall 56. To provide adequate retention of support unit 16*a* in such a configuration with a wall 56 such as that which is illustrated in the example of FIGS. 1-10, system 10 may further include an additional pair of mounting blocks that are identical to the first and second mounting blocks 40,42 described above and, thusly, also referred to as first and second mounting blocks 40,42, with the first mounting block 40 designating the upper mounting blocks in the pairs of first and second mounting blocks 40,42 and the second mounting block 42 designating the lower mounting blocks. In this arrangement, the respective pairs of mounting blocks 40,42 can be spaced from each other to span a significant portion of the depth of the corresponding support unit 16. In this arrangement, the support unit 16*a* can be configured with two connecting members 22 that are both as described above, and thusly both designated as connecting members 22. The connection members 22 are both coupled with the rack support bars 18 spaced positions to provide adequate support for the support bars 18. The additional connecting member 22 is, thusly, coupled with the associated first and second mounting blocks 40,42 in a similar manner to that which is discussed above with the first and second ends 28,34 of the connecting member 22 being respectively received within the associated mounting blocks 40,42.

Additionally, the cavity 12 can define a second vertical wall 58 opposite the first vertical wall 56 and system can, accordingly, further include a second support unit 16*b* that is essentially a mirror image of the support unit 16*a* associated with first vertical wall 56. In that respect, second support unit 16*b* similarly includes rack support bars 18 extending in the first 20 direction and connecting members 22 extending in the second direction 24 and defining respective body portions 26 having the support bars 18 coupled therewith either directly or by way of frame 49. Also similar to the discussion above, connecting members 22 include respective first ends 28 and opposite second ends 34. Similar to the discussion above of first support unit 16*a*, second support unit 16*b* can be releasably coupled with second vertical wall 56 by way of additional pairs or mounting blocks 40,42 that are generally identical to those discussed above, and described further below. As further shown in FIG. 1, the opposite first and second support units 16*a* and 16*b* can be used to retain one or more racks 60 spanning a distance 62 between first and second support units 16*a*,16*b* and resting on a pair of aligned ones of the first and second plurality of rack support bars 18 in a manner similar to a typical oven rack, including facilitating inward and outward sliding of racks 60 with respect to cavity 12, repositioning of racks 60 at various heights and relative spacing within cavity 12, supporting of various cookware articles and/or food items within cavity 12, and the complete removal of racks 60 form appliance 14.

Figure 3:
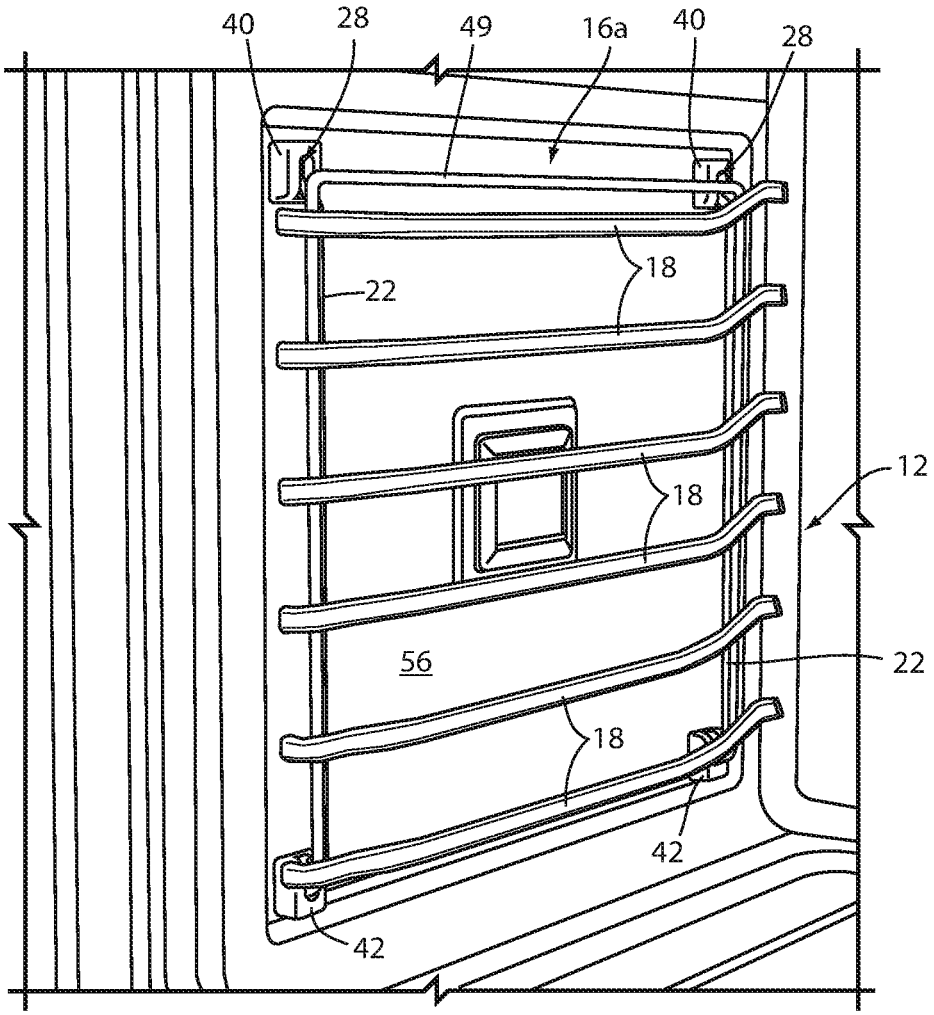
FIG. 3 is a side perspective view of a support unit retained within the oven cavity.
Figure 4:
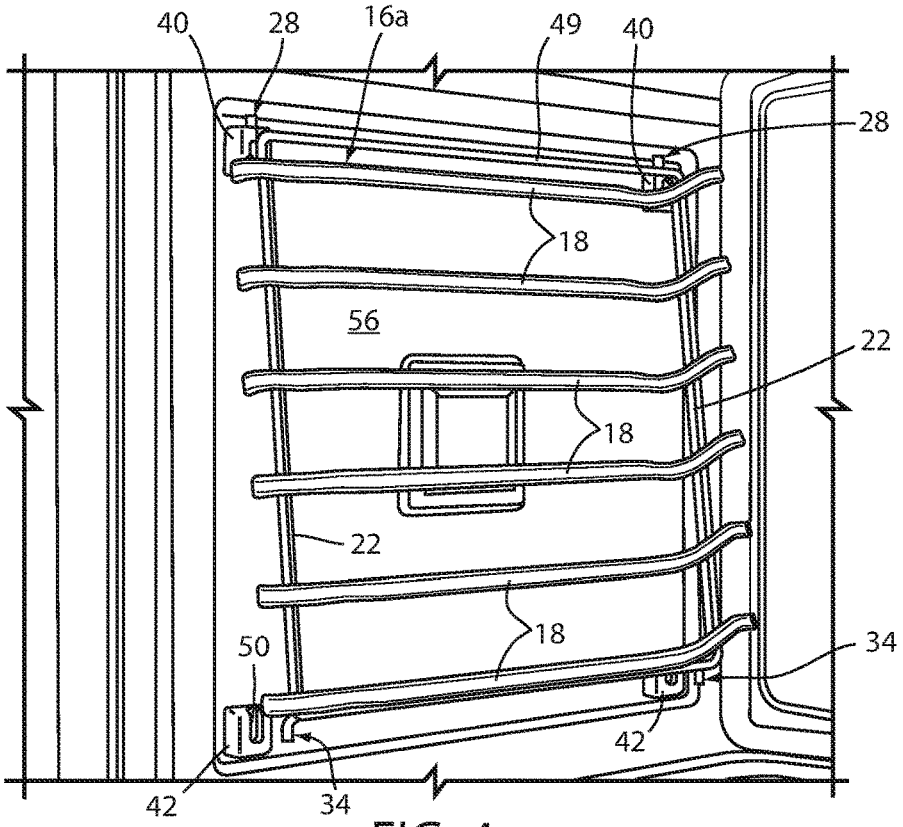
FIG. 4 is a further side perspective view of the support unit in a removal position with respect to the oven cavity.
Figure 5:
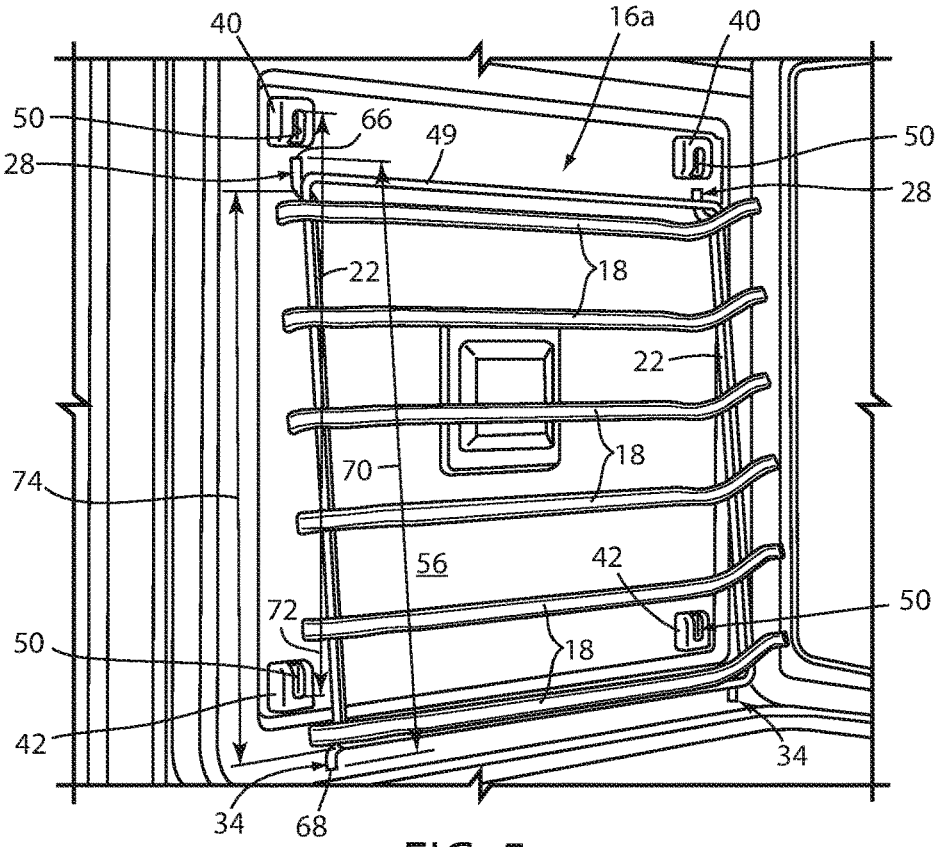
FIG. 5 is a further side perspective view of the support unit in a disengaged position with respect to the oven cavity.

As discussed further below, the mounting blocks 40,42 and the corresponding first and second ends 28,34 of the connecting member 22 facilitate retention of support units 16*a*,16*b* within cavity 12 in the desired position for retention of racks 60 in a removable manner. As shown in FIGS. 3-5, the mutual arrangement between first and second mounting blocks 40,42 and first and second ends 28,34 of connecting members 22 is such that support units 16*a*,16*b* can be disengaged from the respective walls 56,58 to which they are retained by sliding the support unit 16*a* or 16*b* upwardly into an intermediate position, as shown in FIG. 3, rotating the lower end of the support unit 16*a* or 16*b* inwardly away from the wall 56 or 58, as shown in FIG. 4, and moving the support unit 16*a* or 16*b* downwardly, as shown in FIG. 5. Such removal can be used in cleaning support units 16*a*,16*b* and/or cavity 12 including vertical walls 56,58. Additionally, removal can allow replacement of support units 16*a*,16*b* with similar units having different support bar 18 configurations or to replace damaged or worn support units 16*a*,16*b*, for example.

The removable fixation of support units 16*a*,16*b* is particularly achieved by structuring first and second ends 28,34 of the connecting members 22 to be respectively received in the closed portions 54 of the channels 46 of the first and second mounting blocks 40,42 in a slideable manner, which allows the support unit 16*a*,16*b* to be moveable into the intermediate position depicted in FIG. 3. When moved into the intermediate position, the second post 36 of the second end 34 is removed from the closed portion 54 of the associated channel 46 such that post 36 is aligned with the notch 50 in the second mounting block 42. Further, when the support unit is in the intermediate position, at least a portion of the first end 28, including first post 30 is at least partially within the closed portion 54 of the channel 46 of the first mounting block 40 such that some support is provided for support unit 16*a* during the initial stage of the removal process.

As shown in FIG. 4, the support unit 16*a* is further moveable from the intermediate position of FIG. 3 into a removal position by rotation of the support unit 16*a* such that the second end 34 of the connecting member 22 is moved away from the second mounting block and, accordingly, through notch 50 to be clear of the corresponding second mounting block 42. During such rotation, first post 30 remains at least partially within the closed portion 52 of the corresponding channel 46 of first mounting block 42, as discussed further below. From the removal position, support unit 16*a* can be moved into the disengaged position of FIG. 5 by movement of support unit in a downward manner (that may also including simultaneous inward movement away from vertical wall 56) to achieve sliding of the first end 28, particularly of first post 30 out of the channel 46 of the first mounting block 40. When in such a position, support unit 16*a* is fully disengaged from cavity 12 and can be thusly removed therefrom. As can be seen in FIGS. 3-5 the movement of supporting unit 16*a* through the positions shown for removal thereof cause the same movement and reconfiguration of both connecting members 22 with respect to both of the corresponding sets of mounting blocks 40,42. Further, it is noted that support unit 16*b* is removed/disengaged from cavity 12 in a similar manner with upward sliding and rotation away from second vertical wall 56.

As can be appreciated, support units 16*a*,16*b* can be re-assembled with cavity 12 by alignment of first posts 30 with the corresponding notches 50 and/or channels 46 of the respective first mounting blocks 40 (FIG. 5) and upward/outward movement of support unit 16*a*,16*b* to move posts 30 into the closed portions 52 of channel 46 (FIG. 4). Subsequently, support unit 16*a*,16*b* can be rotated with the lower end thereof moving toward the respective wall 56,58 to move second posts 36 through notches 50 and into the open portions 52 of the corresponding channels 46 of the respective second mounting blocks 42. Support unit 16*a*,16*b* can then be lowered into the engaged position of FIG. 1, with both first and second posts 30,36 positioned within the closed portions 54 of the channels 46 in first and second mounting blocks 40,42, respectively.

As mentioned above, the connecting members 22 and mounting blocks 40,42 are mutually structured and positioned to facilitate the above-described retention and removal of support units 16*a*,16*b* from cavity 12. As shown in greater detail in FIGS. 6 and 7, each connecting member 22 defines body portion 26 with first end 28 having first post 30 and first stepped segment 32 between the first post 30 and the body portion 26. Opposite first end 28, second end 34 includes second post 36 and second stepped segment 38 between the second post 36 and the body portion 26. The cross-section views of FIGS. 6 and 7 further illustrate the manner in which first and second mounting blocks 40,42 define their first faces 44 with the respective channels 46 extending inwardly from the first faces 44. The respective second faces 48 are normal to the first faces 44 with notch 50 extending inwardly from first faces 44 and intersecting with the channel 46 such that first portion 52 of the channel 46 is open on the second face 48 and the second portion 54 of the channel 46 is enclosed behind the second face 48. With additional reference back to FIG. 3, the first and second mounting blocks 42 are spaced apart with the respective first faces 44 and, accordingly the open portions of notches 50, disposed toward each other and spaced to mutually retain the first and second posts 30,34 in the respective closed portions 54 of the channels 46 of the first and second mounting blocks 40,42.

Figure 6:
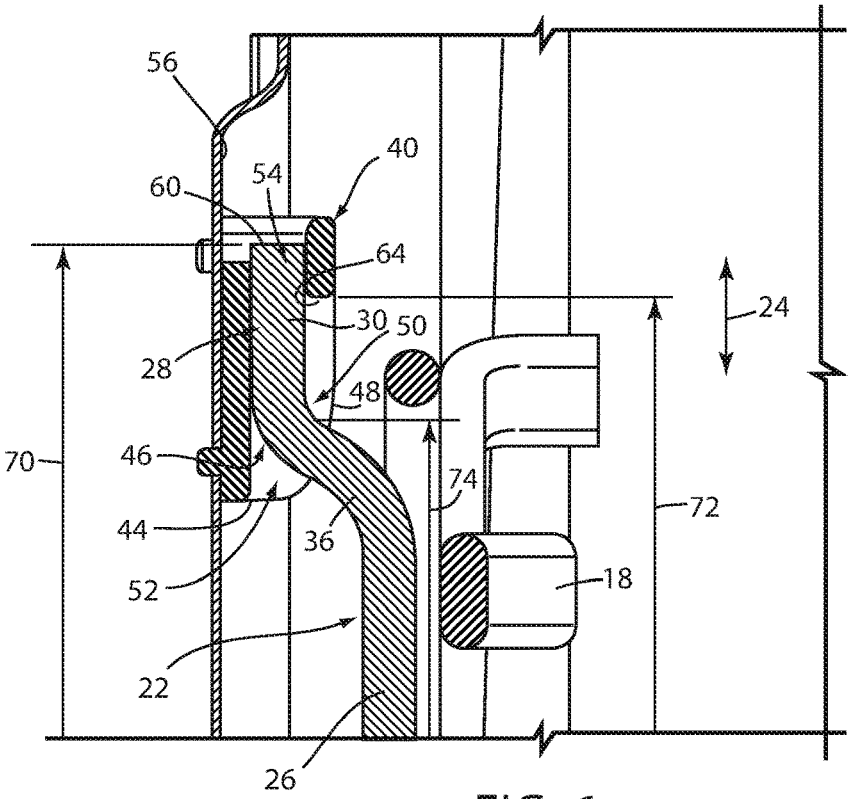
FIG. 6 is a front, cross-section view of a portion of the support unit and a related retention feature associated with the system.
Figure 7:
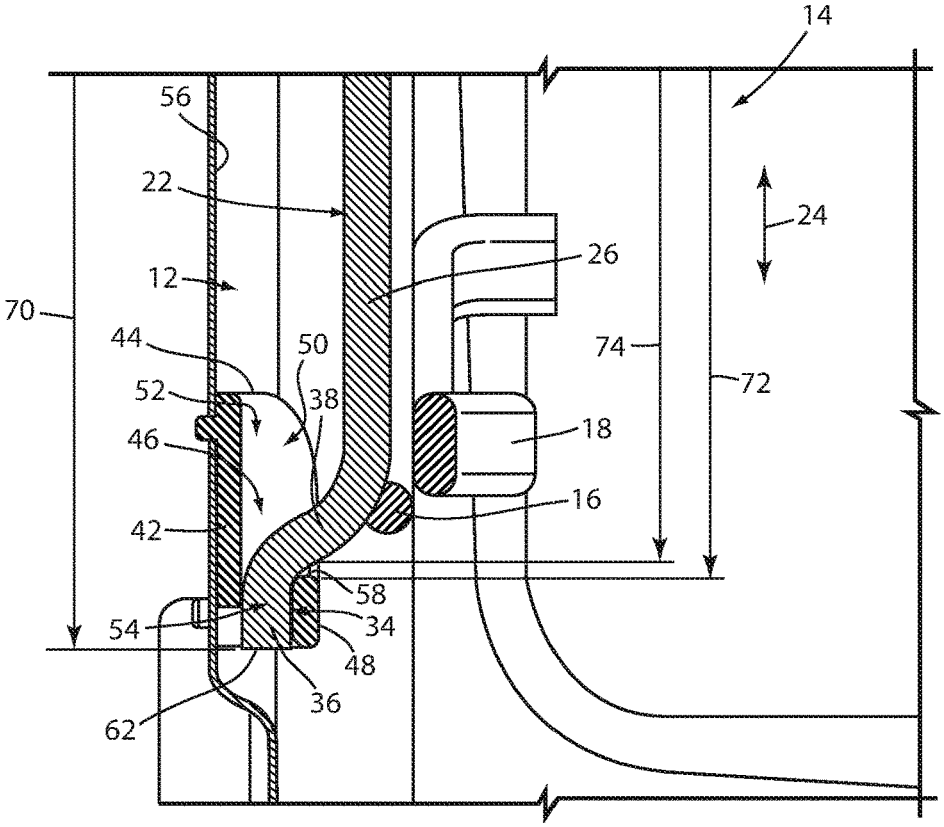
FIG. 7 is a front, cross-section view of another portion of the support unit and a related retention feature associated with the system.
Figure 8:
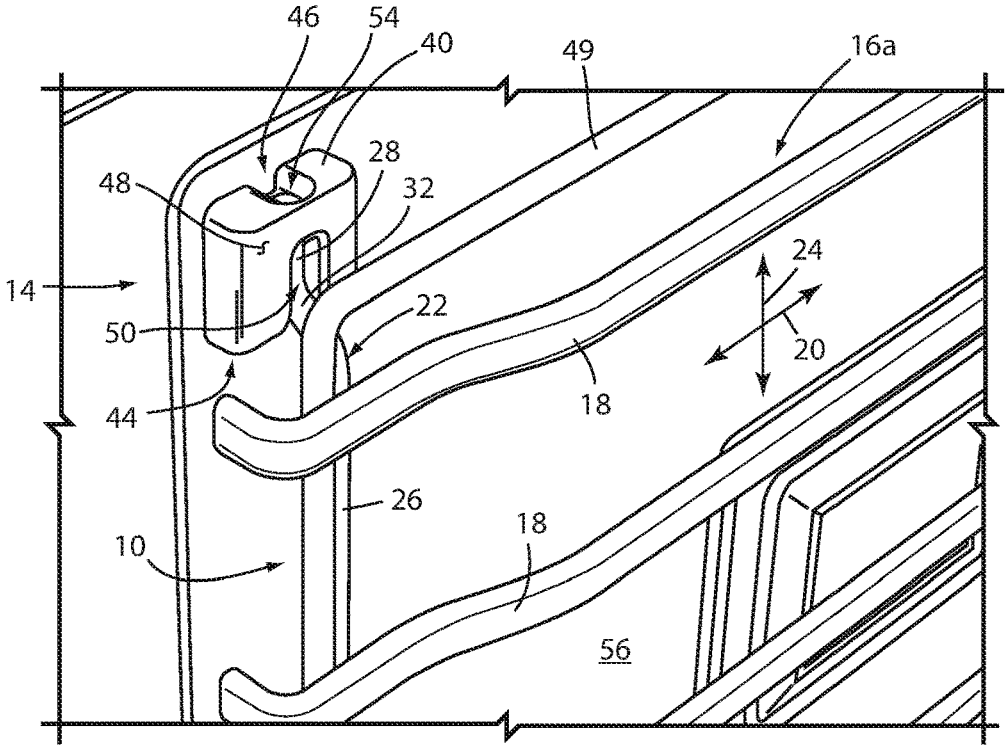
FIG. 8 is a perspective detail view of a portion of the rack system in an installed position.

As further shown in FIGS. 6 and 7, the notches 50 of the first and second mounting blocks 40,42 define respective closed ends 64 along the second faces 48 of the mounting blocks 40,42. As shown in FIG. 7, the second stepped segment 38 of second end 34 of connecting member 22 abuts a portion of the closed end 64 of the notch 50 of the second mounting block 42 when the support unit 16*a* is in an installed condition relative to the first and second mounting blocks 40,42 (the same also applies to support unit 16*b* when in its corresponding position). In this manner, the force of gravity on support unit 16*a* maintains second post 36 in its position within the closed portion 54 of channel 46 with the resting of second stepped segment 38 on the closed end 64 of notch 50 maintaining the corresponding position of connecting member 22 (and therefore support unit 16*a*) in first direction 20.

As shown in FIG. 6, the first mounting block 42 is positioned vertically above the second mounting block (i.e. in first direction 20) in a generally aligned manner such that, when the support unit 16*a* is in the installed position, the body portion 26 of the connecting member 22 extends vertically and is supported by resting of the second stepped segment 38 against the closed end 64 of the notch 50 of the second mounting block 42. The distance between mounting blocks 40,42 in the first direction 20 is, accordingly, such that, when support unit 16*a* is in the installed position, the closed portion 54 of the channel 50 of first mounting block 40 receives first post 30 with the first stepped segment 32 spaced away from the closed end 64 of the notch 50 of first mounting block 40. In such a position, the closed end 64 of notch 50 of first mounting block 40 is spaced from first stepped segment 32 by a distance sufficient to allow support unit 16*a* to be raised into the intermediate position of FIG. 4, in which second post 36 is within the open portion 52 of channel 50, as shown in FIG. 10.

To accommodate the above-described positioning of the closed end 64 of the notch 50 of first mounting block 40 relative to first stepped segment 32, first post 30 is of a length sufficient to remain at least partially within the closed portion 54 of channel 50 both when support unit 16*a* is in the installed position of FIG. 3 and when support unit 16*a* is raised into the intermediate position. In this respect, first stepped segment 32 is present to achieve the desired vertical orientation of body 26 of connecting member 22 and to prevent support unit 16*a* from being raised to a position in first direction 20 in which it interferes with vertical wall 56 during rotation of support unit 16*a* into the intermediate position by abutting the corresponding closed end 64 of the respective notch 50. To achieve the desired sizing of first post 30, a distance 70 between a first end surface 66 defined on first post 30 and a second end surface 68 defined on second post 36 is greater than a distance 72 between the facing closed ends 64 of the notches 50 of the first and second mounting blocks 40,42. In a similar manner, a distance 74 between the first and second stepped segments 32,38 is less than the distance 72 between the closed ends 64 of the notches 50 by approximately the difference between distance 70 and distance 72.

Figure 9:
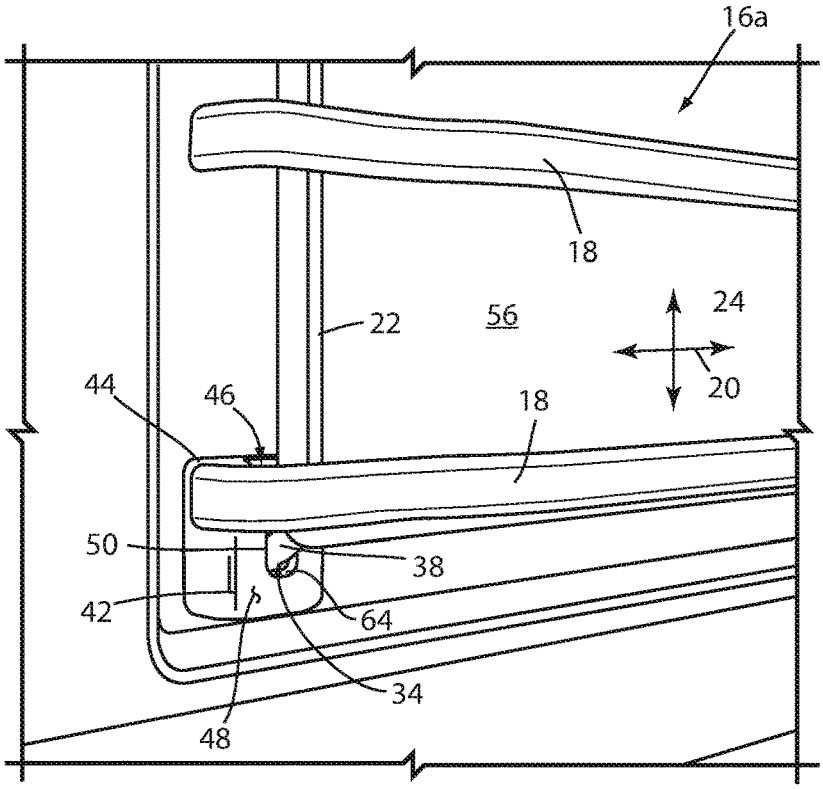
FIG. 9 is a perspective detail view of another portion of the rack system in the installed position.
Figure 10:
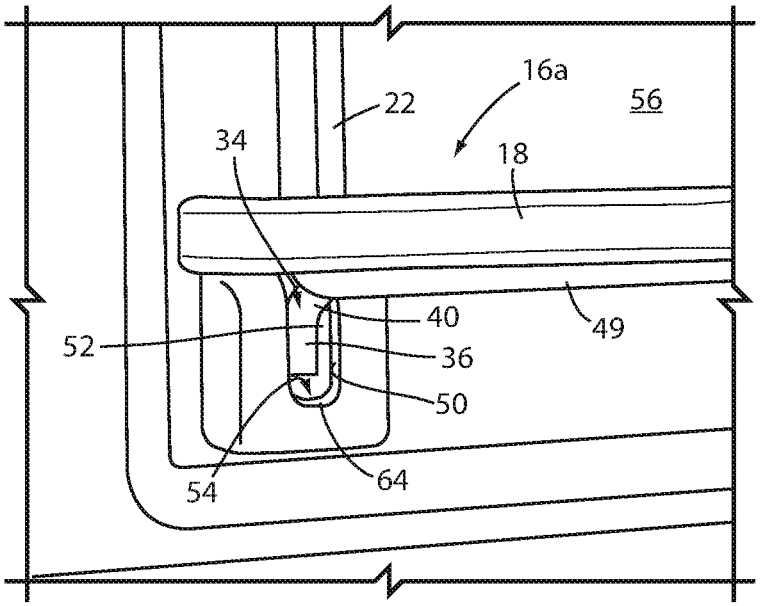
FIG. 10 is a perspective detail view of the portion of the rack system of FIG. 9 in an intermediate position.

The configuration of first and second ends 28,34 with respect to the above-described features of first and second mounting blocks 40,42 facilitates the above-described arrangement in which the first and second posts 30,36 are engaged with the respective channels 50 of the first and second mounting blocks 40,42 in the described slidable manner such that the second stepped segment 38 is moveable away from the closed end 64 of the notch 50 of the second mounting block 40 during movement of the support unit 16*a* into the intermediate position, as shown between FIGS. 9 and 10. When the support unit 16*a* is in the position shown in FIG. 10, the second post 36 is removed from the closed portion 54 of the channel 50, with at least a portion thereof disposed within the open portion 52 of the channel 46 of the second mounting block 42 and aligned with notch 50 for rotation of support unit 16*a* away from wall 56, while the first post 30 remains at least partially within the closed portion 54 of the channel 46 of the first mounting block 40.

As shown in FIG. 6, at least first mounting block 40 can be configured such that channel 46 passes fully therethrough, which can allow for sliding of first post 30 outwardly from first mounting block 40 to accommodate the extended length thereof relative to second post 36. Second mounting block 42 can be similarly structure such that first and second mounting blocks 40,42 can be generally identical in structure with only their relative positioning within cavity 12 differentiating them for purposes of this disclosure. Further, first and second mounting blocks 40,42 can be generally solid structures in the areas surrounding channel 46 and notch 50 and can be of a metallic material or the like able to retain support units 16*a*,16*b*, as described herein, and with heat-resistive qualities to withstand the environment within cavity 12 when appliance 14 is, for example, in the form of an oven.

As noted above, when moved into removal position (FIG. 4) by rotation of the support unit 16*a* such that the second post 36 is moved out of the corresponding channel 46 through the notch 50 of the second mounting block 42 with the first post 30 positioned within the closed portion 54 of the channel 46 of the first mounting block 40. Support unit 16*a* is then moved from the removal position to the disengaged position (FIG. 5) by sliding of the first post 30 out of the channel 46 of the first mounting block 40. As discussed above, support unit 16*a* can be re-installed within cavity 12 by reversing the removal process.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A rack system for a cooking appliance cavity, comprising:

a first support unit including:

a plurality of rack support bars extending in a first direction; and a first connecting member extending in a second direction normal to the first direction and defining a body portion having the support bars coupled therewith, a first end with a first post and a first stepped segment between the first post and the body portion, and a second end with a second post and a second stepped segment between the second post and the body portion;

first and second mounting blocks, each defining a first face with a channel extending inwardly therefrom, a second face normal to the first face and having a notch extending inwardly therefrom and intersecting with the channel such that a first portion of the channel is open on the second face and a second portion of the channel is enclosed behind the second face, the first stepped segment abutting a closed end of the notch of the first mounting block when in an intermediate position relative to the first and second mounting blocks and spaced apart from the closed end of the notch of the first mounting block when in an installed position;

wherein the first and second mounting blocks are spaced apart with the respective notches thereof disposed toward each other and the first and second posts are respectively received in the second portions of the channels of the first and second mounting blocks.

2. The rack system of claim 1, wherein:

the closed ends being spaced apart from the respective first face; and the second stepped segment abuts a portion of the closed end of the notch of the second mounting block when the support unit is in the installed position relative to the first and second mounting blocks.

3. The rack system of claim 2, wherein:

the first and second posts are engaged with the respective channels of the first and second mounting blocks in a slidable manner such that the second stepped segment is moveable away from the closed end of the notch of the second mounting block during movement of the support unit into the intermediate position;

when the support unit is in the intermediate position, the second post is removed from the second portion of the channel, with at least a portion thereof disposed within the first portion of the channel of the second mounting block and the first post is at least partially within the second portion of the channel of the first mounting block.

4. The rack system of claim 3, wherein the support unit is further moveable:

from the intermediate position into a removal position by rotation of the support unit such that the second post is moved out of the channel through the notch of the second mounting block with the first post positioned within the second portion of the channel of the first mounting block; and from the removal position to a disengaged position by sliding of the first post out of the channel of the first mounting block.

5. The rack system of claim 2, wherein:

the first mounting block is positioned vertically above the second mounting block in a generally aligned manner; and when the support unit is in the installed position, the body portion of the first connecting member extends vertically and is supported by resting of the second stepped segment against the closed end of the notch of the second mounting block.

6. The rack system of claim 2, wherein:

the first post defines a first end surface of the first connecting member and the second post defines a second opposite end surface of the first connecting member;

a distance between the first end surface and the second end surfaces is greater than a distance between the closed ends of the notches of the first and second mounting blocks; and a distance between the first and second stepped segments is less than the distance between the closed ends of the notches.

7. The rack system of claim 1, further including third and fourth mounting blocks spaced from the first and second mounting blocks; wherein:

the support unit further includes a second connecting member coupled with the rack support bars in a position spaced from the first connecting member, the second connecting member defining first and second ends; and the first and second ends of the second connecting member are respectively received within the third and fourth mounting blocks.

8. The rack system of claim 1, further including:

a second support unit including:

a second plurality of rack support bars extending in the first direction; and a second connecting member extending in the second direction and defining a body portion having the support bars coupled therewith, a first end with a first stepped segment, and a second end with a second stepped segment opposite the first end;

third and fourth mounting blocks, each defining a first face with a channel extending inwardly therefrom, a second face normal to the first face;

wherein the third and fourth mounting blocks are spaced from the first and second mounting blocks with the second faces thereof facing each other and the first and second ends of the second connecting member are respectively received in the third and fourth mounting blocks.

9. The rack system of claim 8, further including a first rack spanning a distance between the first and second support units and resting on a pair of aligned ones of the first and second plurality of rack support bars.

10. A cooking appliance, comprising:

an interior cavity with a first vertical interior wall;

first and second mounting blocks coupled with the first interior wall, each mounting block defining a first face with a channel extending inwardly therefrom, a second face normal to the first face and having a notch extending inwardly therefrom and intersecting with the channel such that a first portion of the channel is open on the second face and a second portion of the channel is enclosed behind the second face, the first and second mounting blocks being spaced apart with the respective first surfaces thereof disposed toward each other;

a first support unit including:

a plurality of rack support bars extending in a first direction; and a first connecting member extending in a second direction normal to the first direction and defining a body portion having the support bars coupled therewith, a first end with a first post integrally formed with the body portion and offset from the body portion by a first stepped segment extending therebetween, and a second end with a second post integrally formed with the body portion and offset from the body portion by a second stepped segment extending therebetween, the first and second posts being respectively received in the second portions of the channels of the first and second mounting blocks.

11. The cooking appliance of claim 10, wherein:

the notches of the first and second mounting blocks define respective closed ends along the second surfaces thereof; and the second stepped segment abuts a portion of the closed end of the notch of the second mounting block when the support unit is in an installed condition relative to the first and second mounting blocks.

12. The cooking appliance of claim 11, wherein:

the first and second posts are engaged with the respective channels of the first and second mounting blocks in a slidable manner such that the second stepped segment is moveable away from the closed end of the notch of the second mounting block during movement of the support unit into an intermediate position;

when the support unit is in the intermediate position, the second post is removed from the second portion of the channel, with at least a portion thereof disposed within the first portion of the channel of the second mounting block and the first post is at least partially within the second portion of the channel of the first mounting block.

13. The cooking appliance of claim 12, wherein the support unit is further moveable:

from the intermediate position into a removal position by rotation of the support unit such that the second post is moved out of the channel through the notch of the second mounting block with the first post positioned within the second portion of the channel of the first mounting block; and from the removal position to a disengaged position by sliding of the first post out of the channel of the first mounting block.

14. The cooking appliance of claim 11, wherein:

the first mounting block is positioned vertically above the second mounting block in a generally aligned manner; and when the support unit is in the installed position, the body portion of the first connecting member extends vertically and is supported by resting of the second stepped segment against the closed end of the notch of the second mounting block.

15. The cooking appliance of claim 10, further including third and fourth mounting blocks coupled with the first interior wall and spaced from the first and second mounting blocks; wherein:

the support unit further includes a second connecting member coupled with the rack support bars in a position spaced from the first connecting member, the second connecting member defining first and second ends; and the first and second ends of the second connecting member are respectively received within the third and fourth mounting blocks.

16. The cooking appliance of claim 10, wherein the interior cavity has a second vertical interior wall spaced from and generally parallel to the first interior wall, the appliance further including:

third and fourth mounting blocks coupled with the second interior wall, each of the third and fourth mounting blocks defining a first face with a channel extending inwardly therefrom, a second face normal to the first face, the third and fourth mounting blocks being spaced from the first and second mounting blocks with the second faces thereof facing each other; and a second support unit including:

a second plurality of rack support bars extending in the first direction; and a second connecting member extending in the second direction and defining a body portion having the support bars coupled therewith, a first end, and a second end opposite the first end, the first and second ends of the second connecting member being respectively received in the third and fourth mounting blocks.

17. The cooking appliance of claim 16, further including a first rack spanning a distance between the first and second support units and resting on a pair of aligned ones of the first and second plurality of rack support bars.

18. A rack system, comprising:

a first support unit including:

a plurality of rack support bars extending in a first direction; and a first connecting member extending in a second direction normal to the first direction and defining a body portion having the support bars coupled therewith, a first end, a stepped segment extending between the first end and the body portion, and a second end opposite the first end;

first and second mounting blocks, each defining a first face with a channel extending inwardly therefrom, a second face normal to the first face and defining a notch extending inwardly therefrom, each of the channels defining respective closed portions;

wherein the first and second mounting blocks are spaced apart with the first faces thereof facing each other, and the first and second ends of the first connecting member are respectively received in the closed portions of the channels of the first and second mounting blocks in a slidable manner such that the support unit is moveable into an intermediate position with the second end removed from the closed portion of the channel and the stepped segment abutting a closed end of the notch of the first mounting block.

19. The rack system of claim 18, wherein, when the support unit is in the intermediate position, at least a portion of the first end is at least partially within the closed portion of the channel of the first mounting block.

20. The rack system of claim 18, wherein the support unit is further moveable:

from the intermediate position into a removal position by rotation of the support unit such that the second end is moved away from the second mounting block with the first end positioned within the closed portion of the channel of the first mounting block; and from the removal position to a disengaged position by sliding of the first end out of the channel of the first mounting block.

* * * * *